US005479743A

United States Patent [19]

Queen et al.

[11] Patent Number: 5,479,743

[45] Date of Patent: Jan. 2, 1996

[54] INFLATABLE EMERGENCY SHELTER

[76] Inventors: Lorne Queen; Kevin Queen, both of RR#1 Keewatin, Ontario, Canada, P0X 1C0

[21] Appl. No.: 281,545

[22] Filed: Jul. 28, 1994

[51] Int. Cl.[6] ..... E04G 11/04

[52] U.S. Cl. ..... 52/2.22

[58] Field of Search ..... 52/2.18, 2.22, 52/2.25

[56] References Cited

U.S. PATENT DOCUMENTS

| | | | |
|---|---|---|---|
| 2,819,724 | 1/1958 | Barker | 52/2.18 |
| 3,055,379 | 9/1962 | Fink | 52/2.18 |
| 5,007,212 | 4/1991 | Fritts | 52/2.18 |

FOREIGN PATENT DOCUMENTS

| | | | |
|---|---|---|---|
| 1181655 | of 0000 | Canada . | |
| 1262856 | of 0000 | Canada . | |
| 1126612 | 6/1982 | Canada | 52/2.18 |
| 2190408 | 11/1987 | Canada | 52/2.18 |
| 43762 | 1/1982 | European Pat. Off. | 52/2.18 |
| 2104934 | 3/1983 | United Kingdom | 52/2.18 |

*Primary Examiner*—Carl D. Friedman
*Assistant Examiner*—Yvonne Horton-Richardson
*Attorney, Agent, or Firm*—Lynn S. Cassan; Robert H. Barrigar

[57] ABSTRACT

There is disclosed an erectable portable emergency shelter for use in cold conditions. This comprises a wind-proof fabric enclosure having an inflatable floor as a base and inflatable ribs for supporting an upper section mountable on the base. There is in one embodiment a hinge between the base and upper section such that the upper section can be opened to uncover the entire floor. This allows an injured person to be moved onto or off of the floor by assistants without fetter of the upper section. There is also a seal provided between the upper section and the base for when the upper section is not open at the hinge. There is further provided a vestibule having means for providing heat-loss limiting entry or exit of a person from the shelter. Various other survival assisting features may be included. In another aspect there is a survival kit which includes the shelter, interior combustion heat generation means, and possibly other safety features.

25 Claims, 5 Drawing Sheets

INFLATABLE EMERGENCY SHELTER

FIELD OF THE INVENTION

The present invention relates to an inflatable emergency shelter and an emergency kit including such shelter for use in a cold environment, for example by survivors of an emergency landing of an aircraft, or by someone whose motorized vehicle, eg. automobile or snowmobile, has failed.

BACKGROUND OF THE INVENTION

The onset of hypothermia is a serious risk to the health of any person stranded in a cold environment. In severe cases amputation of limbs or death can result. Hypothermia can also be an added complication to those suffering injuries arising from an aircraft emergency landing, auto or snowmobile accident, or the like, decreasing the chances of survival for the injured as well as those who may be initially well enough to treat the injured. Typically when a person is stranded, or when there are survivors of an accident in a cold region, shelters and equipment for providing heating, food and first aid are improvised from the surrounding natural environment and/or a failed vehicle or wreckage. Understandably, such equipment and shelter are often inadequate, and in many circumstances may in fact be impossible to provide due to physical impairment from injuries, or lack of suitable materials for improvisation, or the severity of cold temperatures. Even if there are conventional portable shelters available, eg. tents, such are not well adapted to meet the needs of stranded and/or injured persons in cold: manual dexterity, particularly of the hands, is required for manipulation of parts during erection of conventional tents, which dexterity is normally impaired in severe cold; and there are few, if any, design elements in conventional tents for heat preservation or generation, or which facilitate use by severely injured persons under the assistance of others.

In order to provide insulation from cold ground, some prior tent designs have incorporated an inflatable floor, eg. Canadian Patent No.1,126,612 (Westrop). Another has provided for an inflatable floor and walls combination, ie. Canadian Patent No. 1,181,655 (Topolnikov). But these do not disclose features which facilitate the shelter of, or access to shelter by, severely injured persons who must be carried into the shelter by one or more assistants. Also, they do not incorporate features for heat preservation.

Canadian Patent No. 1,262,856 (Hayashida) discloses a tent for emergency use in extreme cold conditions, but such is not easy to set up, particularly for one suffering from injuries or cold impairment. Also, notwithstanding a hinged front opening for better access to the interior by an injured person, such opening does not allow for complete, unobstructed access to the entire floor area which, for example, would be advantageous when one (or more) assistant is carrying an injured person into the tent and therefore requires sufficient room to manoeuvre the injured person onto the interior floor without putting the assistant at additional risk of injury, eg. by straining to fit through an opening while carrying the injured person. Furthermore, there is no feature of the Hayashida tent to limit heat loss upon entry or exit from the tent. None of the foregoing patents contemplates an emergency survival kit in which the tent is one part.

It is apparent that there is a need for an emergency shelter for extreme cold conditions that is easy to set-up in severe cold, provides easy access for a severely injured (immobilized) person under assistance, and provides features favouring heat retention and limited heat loss when a person, other than an immobilized person, enters or exits the shelter.

Furthermore, there is a need for such a shelter which additionally facilitates heat generation, provides physical comfort for the occupants, and facilitates rescuers in locating the persons using the shelter. It is therefore an object of the present invention to meet the foregoing needs.

SUMMARY OF THE INVENTION

The invention provides, in a broad aspect, an erectable portable emergency shelter for use in cold conditions. The shelter comprises includes a substantially air impermeable fabric enclosure having an inflatable floor as a base and inflatable ribs for supporting an upper section mountable on the base. There is a hinge between a part of a lowermost perimeter edge of the upper section and an adjacent part of a perimeter edge of the base, such that the upper section is openable substantially entirely to uncover the floor. The latter feature allows for ready and unobstructed access to the floor, for example when lifting an injured person into the tent, even when the injured person is being lifted by two or more people. There is also means to provide a seal between a non-hinged part of the lowermost edge of the upper section and an adjacent non-hinged part of the perimeter edge of the base, which seal is preferably achieved using Velcro™ fastener material. The latter offers the advantage of a substantially air impermeable seal. The enclosure includes a vestibule having means for providing heat-loss limiting entry or exit of a person from the enclosure, preferably by means of openable fabric covers. The inflatable floor and inflatable ribs are inflatably separate and include manual inflation-facilitating means, eg. an openable and closable nozzle for injecting air. Preferably there is self-inflation means for the inflatable ribs and inflatable floor, which is further preferably a pressurized inflation-gas source. The upper section preferably forms a quonset-like shape. The vestibule preferably has a plurality of inflatable ribs for giving the vestibule a quonset-like shape, and the maximum height of the vestibule preferably is less than two-thirds of the height of the upper section.

The floor preferably includes a lowermost puncture resistant layer. The base preferably includes a plurality of flaps extendible horizontally on ground from the perimeter of the base, which flaps are adapted to underlie a weight-means and thereby secure the base in position.

There are at least four of the inflatable ribs in the upper section, in one preferred aspect. In another preferred aspect there is a mount for an interior, centrally suspendible combustion heating means, and a fume vent at a top-most area of the upper section. The heating means preferably comprises a mounted candle, which may be provided as an accessory. The heating means may also comprise means mounted above the candle for melting snow, in which case drinking water may be obtained.

A plurality of spaced-apart tie-down attachment means, which are preferably rings, may be provided on the upper section. Supplemental external rib support attachment means may also be provided on an exterior of each rib. The latter attachment means may include a plurality of spaced-apart fabric straps for securing the supplemental external rib support adjacent to the rib at preselected points along the length of the rib, as well as a base pocket for securing a lower end of the supplemental external rib support adjacent to a lower end of the rib.

A plurality of clothes-drying hooks suspended from an upper inner surface region of the upper section may be provided. A means for suspending a container of heated rocks from an upper inner surface region of the upper section may further be provided. Preferably, such container is made of steel mesh and may be included as an accessory.

A self-powered strobe light may be attached to an upper exterior area of the upper section. Preferably, the strobe light is solar powered.

The vestibule may include a fabric door at each of the front and rear openings. Each door may be sealable with Velcro™.

In another broad aspect there is provided a portable emergency kit for use in cold conditions which comprises an erectable portable emergency shelter of the kind described above together with a combustion heating means for use inside the shelter. Optionally, the kit may include any combination of one or more of the following: fuel tank puncture means; hose and nozzle means for removing fuel from a fuel tank; fuel container; heat retentive clothing for hands and feet; interiorly suspendible container for heated rocks; small animal trap means; and fire igniter means, preferably a propane igniter.

In a further broad aspect there is provided an erectable portable emergency shelter for use in cold conditions, which comprises: a substantially air impermeable, fabric enclosure having an inflatable floor as a base and inflatable ribs for supporting an upper section mountable on the base, the enclosure including a vestibule having means for providing heat-loss limiting entry or exit of a person from the enclosure; means for facilitating manual inflation of the inflatable floor and inflatable ribs; self-inflation means comprising a pressurized inflation-gas source, for self-inflation of the inflatable floor and inflatable ribs; means for securing the shelter in position on ground; means for providing combustion heat in the interior of the shelter including a fume vent in the upper section; attachment means for securing the upper section to supplemental external support means; a self-powered strobe light; and a sealable fabric door for each of front and rear openings of the vestibule. Preferably, the base is substantially circular in perimeter and the upper section is substantially dome-shaped.

DESCRIPTION OF THE DRAWINGS

Preferred embodiments of the invention are illustrated in the drawings in which.

DESCRIPTION OF THE PREFERRED EMBODIMENTS

Figure 2A:
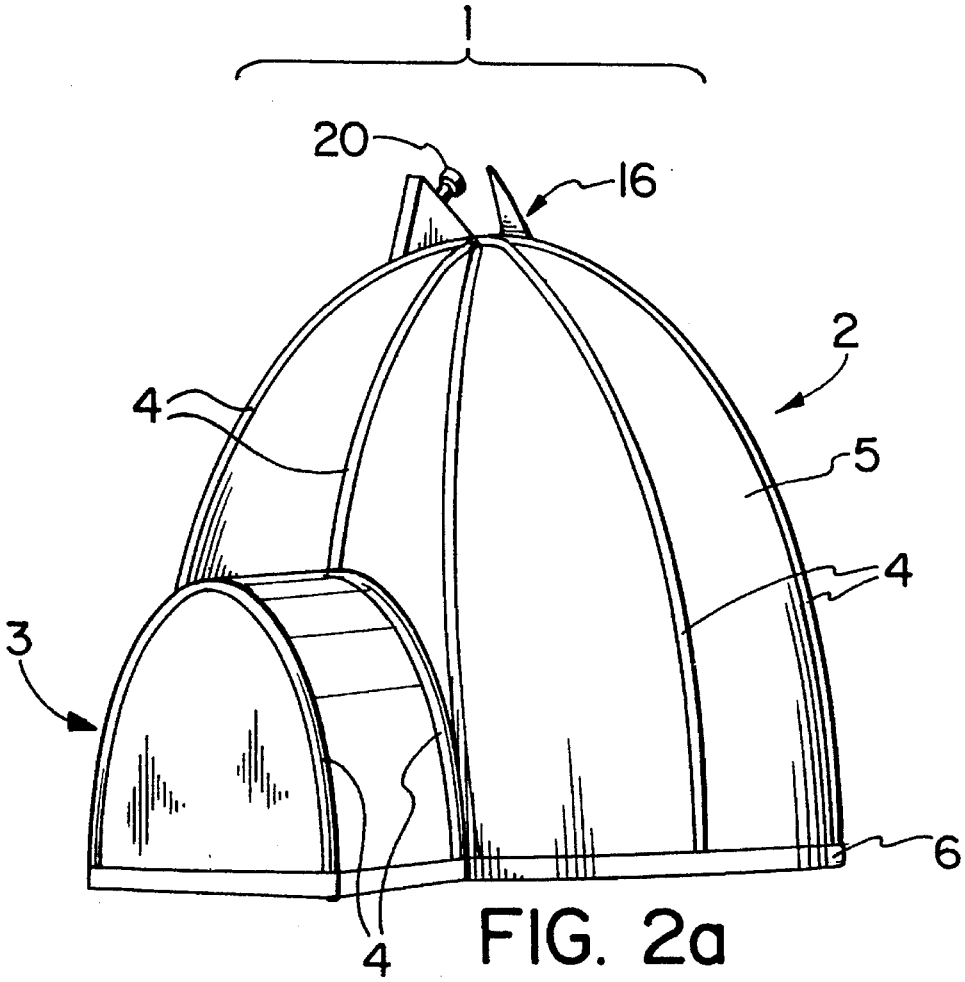
FIG. 2*a* is a perspective view from the front and slightly to a side of a shelter according to the invention in which the base of the main section has a circular perimeter and the upper section is dome-shaped.
Figure 2B:
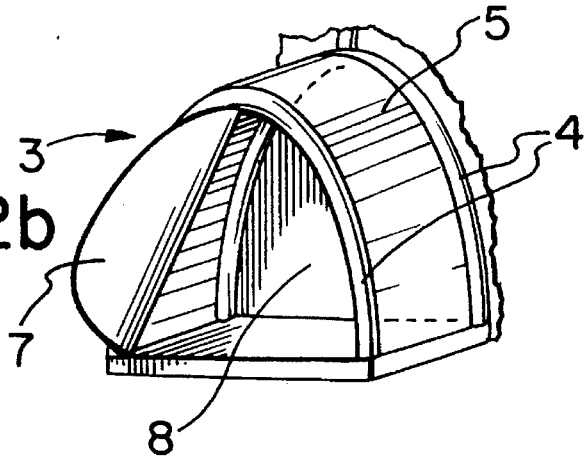
FIG. 2*b* shows a perspective view from the front and slightly to a side of the vestibule of FIG. 2*a* with the front door flap open and back door flap closed.

In first referring to FIG. 2*a* there is shown a shelter 1 having, as structural support for the main section 2 and vestibule 3, inflatable ribs 4. A known air impermeable and optionally water-proof or water-resistant fabric forms the walls 5 of the shelter. Such fabric may, for example, be nylon selectively with layers or treated to give the above properties. The ribs may be made of conventional inflatable air-tight tube material, such as rubberized nylon, as is used in inflatable air mattress production generally. Preferably the ribs are made of known wear and puncture-resistant construction for air-tube products. The shelter of FIG. 2*a* also shows the main section 2 having a dome-shape. Such shape is preferred when the base 6 is circular in perimeter (discounting the vestibule), although variations of the shape of the base perimeter and the main section may be achieved without departing from the invention. The vestibule 3 is shown in FIG. 2*b* with an open front door-flap 7 and a closed back door-flap 8. When in use in cold conditions a person entering or leaving the main section 2 can open and close the front and back door-flaps 7,8 sequentially so as to limit heat loss from the main section 2. Preferably, the door-flaps 7,8 are sealable around the openable perimeter of each door-flap with Velcro™ fastener material to provide substantially air impermeable door-flap seals.

Figure 3A:
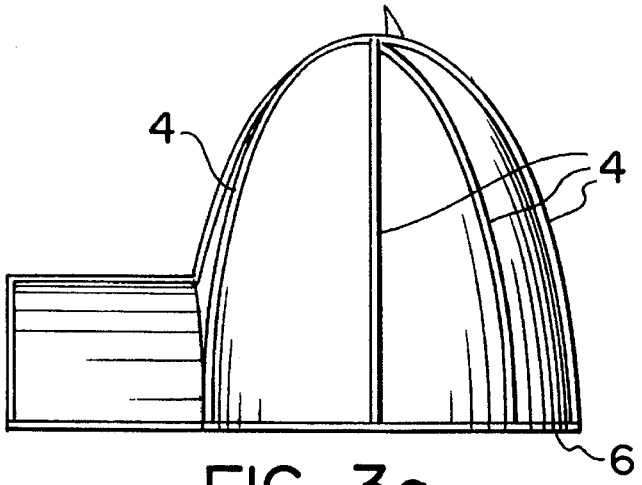
FIGS. 3*a*, 3*b* and 3*c* respectively are side, top and front outline views of the shelter of FIG. 2*a*; and, FIG. 4 is a cross-sectional front view of the main section of the shelter of FIGS. 1*a*–1*c*.
Figure 3B:
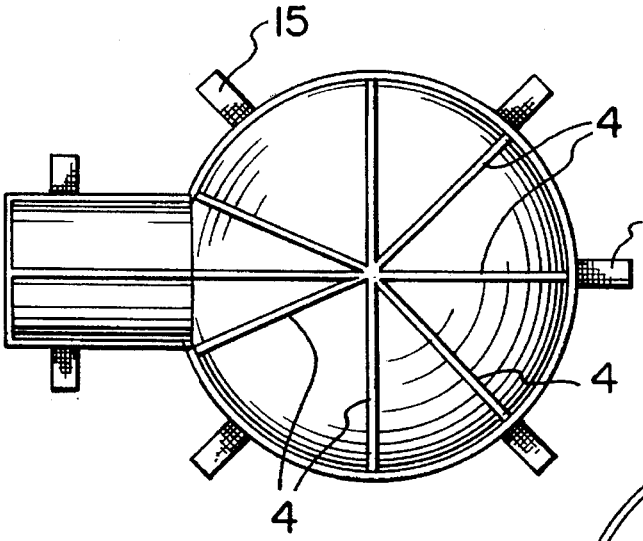
Figure 3C:
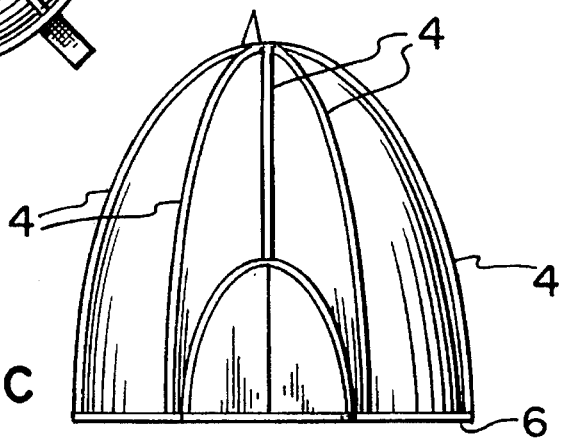

FIGS. 3*a*–3*c* show one possible configuration for the inflatable ribs 4 in the shelter of FIG. 2*a*.

Figure 1A:
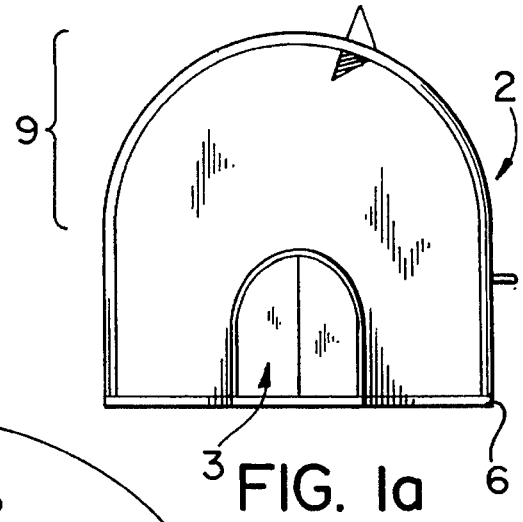
FIG. 1*a* shows a front outline view of a shelter having a rectilinear base perimeter.

FIG. 1*a* shows an alternate shape for the shelter of the present invention. In particular, the base 6 is rectangular in perimeter (best seen in FIG. 1*c*) and the main section 2 has a quonset-like top area 9. The vestibule 3 may also have a quonset-like top section and be centrally positioned on the front of the main section as seen in FIG. 1*a*, or positioned off-centre for example as shown in FIG. 1*d*.

Figure 1B:
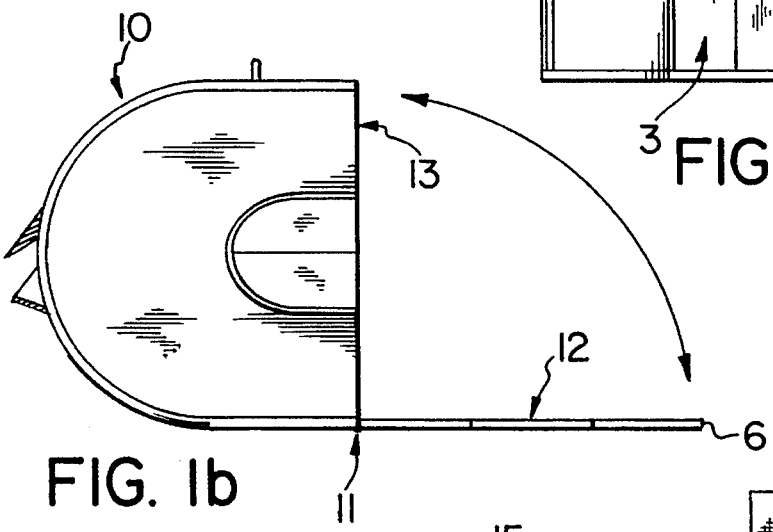
FIG. 1*b* shows a front view of the shelter of FIG. 1*a* when an upper section of the shelter is fully opened from a hinge.
Figure 1C:
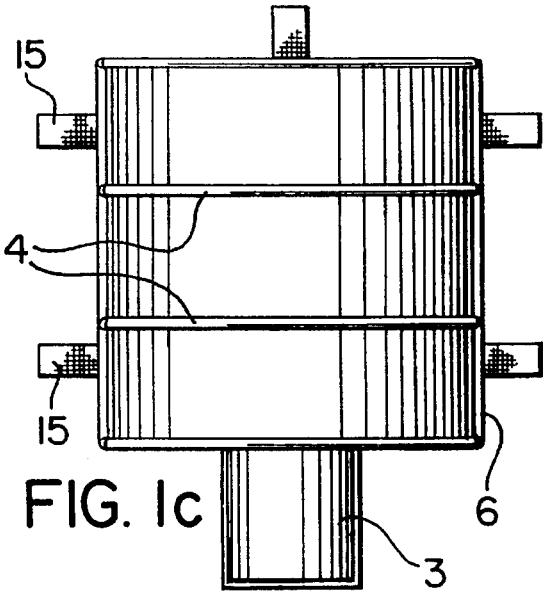
FIG. 1*c* shows a top outline view of the shelter of FIG. 1*a*.
Figure 1D:
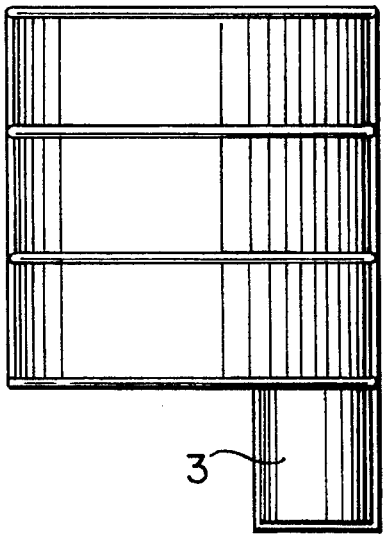
FIG. 1*d* shows a top outline view of a modified version of the shelter of FIG. 1*a* wherein the vestibule is positioned at a side of the main section of the shelter.
Figure 1E:
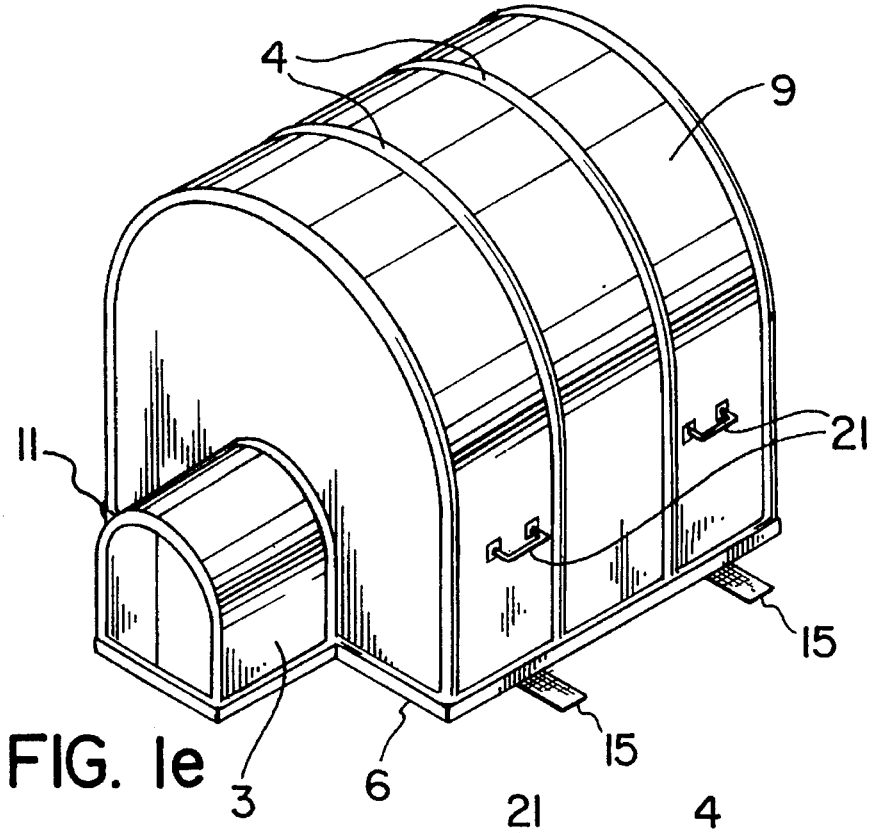
FIG. 1*e* shows a perspective view from the front and slightly above and to one side of the shelter of FIG. 1*a*.
Figure 1F:
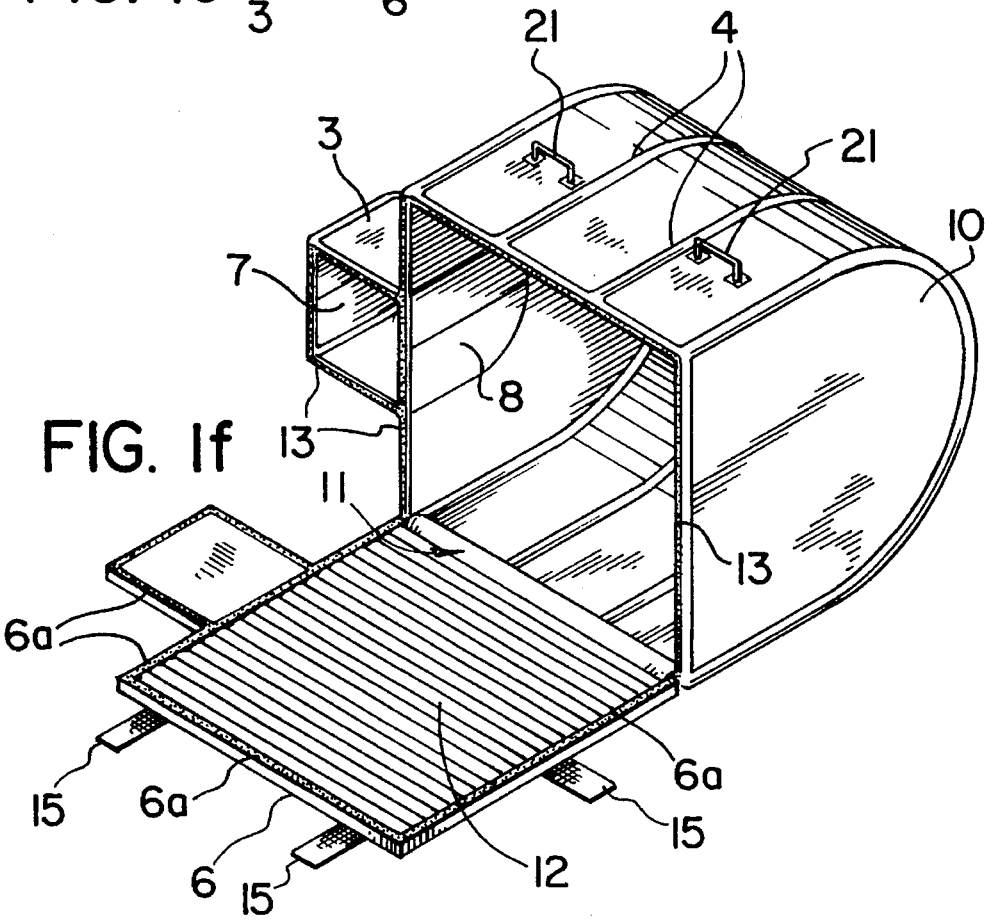
FIG. 1*f* shows a perspective view from a side and slightly above and behind the shelter of FIG. 1*a* when the shelter is open from a hinge on the other side of the shelter.

FIGS. 1*b* and 1*f* shows how an upper section 10 of the main section 2 can be joined to the base 6 at the hinge 11 so as to permit the entire upper section 10 to be opened to uncover the floor 12 (see the double-ended arrow in FIG. 1*b* which indicates such movement). It may be appreciated that the upper section 10 in FIG. 1*b* is shown resting sideways on the ground. When the upper section 10 is open in this manner it is possible to have unfettered access to the entire floor area of the shelter. This is particularly useful when moving an injured person into or out of the shelter, in that the restricted space of the vestibule and the main section can be entirely avoided. Thus it is possible for two or three or more assistants to carry the injured person directly to a relatively safe, comfortable position on the floor of the shelter without any additional difficult and unsafe manoeuvering of the injured person and themselves that would otherwise be occasioned by the restrictions of the vestibule and main section. Indeed, without the hinged opening feature it may be impossible for the injured person to be moved into the shelter, depending on the nature of the injuries, size and weight of the injured person and the number and physical capabilities of the assistants. The upper section 10 can be closed back onto the base 6 after the injured person has been placed on the floor or removed. The hinge 11 is preferably made of double-stitched, double layered material for strength and durability. Velcro™ fastener material may be provided as a substantially air impermeable seal between the lower edge 13 (preferably the "felt" side of Velcro™) and perimeter of the base 6 at 6*a* (preferably the "hook" side of Velcro™) when the upper section 10 is in the closed position. In view of the strength of the Velcro™ seal it is advantageous to provide pull-up handles 21 on the upper section 10, as shown in FIGS. 1*e* and 1*f*. Such handles are useful in the opening of the shelter at the hinge 11.

Figure 4:
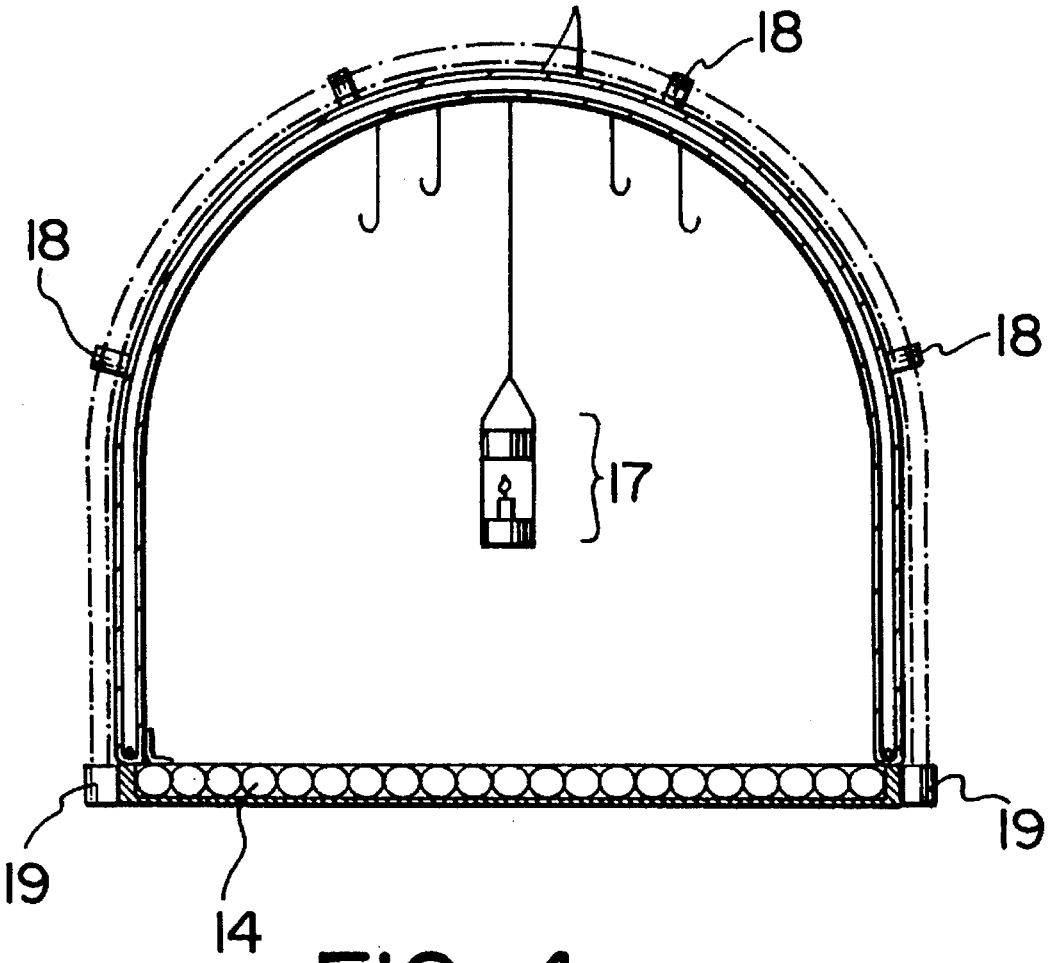

The floor 12 is inflatable and may be constructed in the manner of a conventional air-mattress (see the air tubes 14 in FIG. 4). In the embodiment of FIGS. 1*b*, 1*e* and 1*f*, the floor preferably is separately inflatable from the inflatable ribs 4. This is because a single common inflation supply, if provided, would involve additional construction complexity and cost in order to supply inflation air on both sides of the hinge. So, it is preferred to provide separate inflation air to each side of the hinge. Thus, the ribs 4 of the upper section may be inflated through one conventional air filling nozzle, eg. manually or by pressurized air from a canister, and the floor through another nozzle.

The perimeter of the base 6 is preferably provided with flaps 15 (see FIGS. 1*c*, 1*e*, 1*f* and 3*b*) which lie horizontally on the ground. Weights such as rocks can then be placed on the flaps so that the shelter can be more secure against shifting or tipping forces, eg. from wind when setting up the shelter. The flaps also can be stood upon by a person when opening the shelter from the hinge 11, ie. as additional assist in opening the shelter against the strength of the Velcro™ seal. The flaps may be made of any known weather resistant durable fabric, eg. reinforced nylon.

The preferred embodiments of the invention include means for facilitating use of a combustion heat source in the interior of the shelter. Thus there is shown in FIG. 2*a*, for example, a vent 16. This is a simple closeable flap in the fabric at about the top of the main section 2. The vent 16 allows for the use of a preferred accessory which is an interior heating means 17 (see FIG. 4) suspended from the top area of the interior of the main section. Such heating means may be a mounted candle, eg. in a metal cup, and may additionally include a snow melting cup above the candle. Snow is typically abundant in cold conditions whereas water is not, and therefore providing means for melting snow can provide a more convenient and safer supply of drinking water. Note that the alternative of eating snow will be conducive to cooling a person, which thereby increases the risk of the onset of hypothermia.

The invention also contemplates that a heat source resting on and insulated from the floor of the shelter may be provided, as opposed to being suspended, although this is not illustrated.

The preferred embodiments of the invention also facilitate alternative means of supporting the main section, ie. in the event the inflatable ribs 4 will not or cannot be inflated. Thus, there are shown straps 18 and pockets 19 (see FIG. 4) for holding the main section onto exterior supports such as willow branches. Preferably the straps are Velcro™ fasteners and the pockets are reinforced nylon sewn or otherwise fastened to the main section.

The preferred embodiments also include a plurality of hooks or straps for suspension or suspended from the interior of the main section, so that damp articles of clothing can be hung to dry.

The shelter also preferably includes features to enhance its visibility and thereby the chances of rescue by search aircraft, for example. Thus there is shown a self-powered strobe light 20, preferably solar powered, attached to the exterior of the main section. The colour of the exterior of the shelter is also preferably blaze-orange.

When a preferred embodiment of the shelter as described herein is included as part of a survival kit for example for storage on an aircraft, other parts of the kit may include one or more of the following: the above described interior heating means; an ignition device for starting fires, preferably a propane igniter; warm clothing especially for hands and feet; and a suspendible mesh bag, preferably made of stainless steel, for holding hot rocks inside the shelter (the rocks can be made hot by heating on an exterior fire). Other accessories suitable for the emergency shelter include: a fuel tank puncture tool, which essentially is a sharp steel point on a handle, eg. an army knife; a hose and nozzle for removing fuel from a fuel tank and a portable, collapsible fuel storage tank. The combination of the latter accessories may enable access to fuel in a wreckage or non-functioning vehicle and thereby enhance heating capabilities. Another accessory contemplated under the present invention is one or more sticky-type small animal traps for catching squirrels, chipmunks, mice and the like, as a possible emergency food source. Emergency food rations of the well known variety, eg. dehydrated food, may also be included in the survival kit.

I claim:

1. An erectable portable emergency shelter for use in cold conditions, which comprises:

a substantially air impermeable, fabric enclosure having an inflatable floor as a base and inflatable ribs for supporting an upper section mountable on the base;

a hinge between a part of a lowermost perimeter edge of the upper section and an adjacent part of a perimeter edge of the base, such that the upper section is openable substantially entirely to uncover the floor;

means to provide a seal between a non-hinged part of the lowermost edge of the upper section and an adjacent non-hinged part of the perimeter edge of the base; and, the enclosure including a vestibule having means for providing heat-loss limiting entry or exit of a person from the enclosure.

2. The shelter of claim 1 wherein the inflatable floor and inflatable ribs are inflatably separate and include manual inflation-facilitating means.

3. The shelter of claim 2 further comprising self-inflation means for the inflatable ribs and inflatable floor, said self-inflation means comprising a pressurized inflation-gas source.

4. The shelter of claim 1 wherein the upper section forms a quonset-like shape.

5. The shelter of claim 1 wherein the vestibule has a plurality of inflatable ribs for giving the vestibule a quonset-like shape, and the maximum height of the vestibule is less than two-thirds of the height of the upper section.

6. The shelter of claim 1 wherein the floor includes a lowermost puncture resistant layer.

7. The shelter of claim 1 wherein the base includes a plurality of flaps extendible horizontally on ground from the perimeter of the base, which flaps are adapted to underlie a weight-means and thereby secure the base in position.

8. The shelter of claim 1 wherein there are at least four of the inflatable ribs.

9. The shelter of claim 1 which further comprises a mount for an interior, centrally suspendible combustion heating means, and a fume vent at a top-most area of the upper section.

10. The shelter of claim 9 wherein the heating means comprises a mounted candle which is provided as an accessory.

11. The shelter of claim 10 wherein the heating means further comprises a container for snow mounted above the mounted candle, whereby the snow can be melted to provide drinking water.

12. The shelter of claim 1 which further comprises a plurality of spaced-apart tie-down attachments on the upper section substantially above the base.

13. The shelter of claim 1 which further comprises supplemental external rib support attachments on an exterior of each rib.

14. The shelter of claim 13 wherein the attachments comprise a plurality of spaced-apart straps for securing a supplemental external rib support adjacent to a rib at preselected points along a length of the rib, and a base pocket for securing a lower end of the supplemental external rib support adjacent to a lower end of the rib.

15. The shelter of claim 1 which further comprises a plurality of clothes-drying hooks suspended from an upper inner surface region of the upper section.

16. The shelter of claim 1 which further comprises a means for suspending a container of heated rocks from an upper inner surface region of the upper section.

17. The shelter of claim 16 wherein the container is made of steel mesh and the container, without rocks, is included as an accessory.

18. The shelter of claim 1 which further comprises a self-powered strobe light attached to an upper exterior area of the upper section.

19. The shelter of claim 1 wherein the means to provide the seal is Velcro™ fastener material.

20. The shelter of claim 1 wherein the vestibule includes a sealable fabric door over each of front and rear openings.

21. An erectable portable emergency shelter for use in cold conditions, which comprises:

a substantially air impermeable, fabric enclosure having an inflatable floor as a base and inflatable ribs for supporting an upper section mountable on the base;

a hinge between a part of a lowermost perimeter edge of the upper section and an adjacent part of a perimeter edge of the base, such that when erected the upper section is openable substantially entirely to uncover the floor;

means to provide a seal between a non-hinged part of the lowermost edge of the upper section and an adjacent non-hinged part of the perimeter edge of the base;

the enclosure including a vestibule having means for providing heat-loss limiting entry or exit of a person from the enclosure;

means for facilitating manual inflation of the inflatable floor and inflatable ribs;

self-inflation means comprising a pressurized inflation-gas source, for self-inflation of the inflatable floor and inflatable ribs;

means for securing the shelter in position on ground;

means for providing combustion heat in the interior of the shelter including a fume vent in the upper section;

attachment means for securing the upper section to supplemental external support means;

a self-powered strobe light; and, a sealable fabric door for each of front and rear openings of the vestibule.

22. A portable emergency kit for use in cold conditions which comprises:

(a) an erectable portable emergency shelter comprising:

a substantially air impermeable, fabric enclosure having an inflatable floor as a base and inflatable ribs for supporting an upper section mountable on the base;

a hinge between a part of a lowermost perimeter edge of the upper section and an adjacent part of a perimeter edge of the base, such that the upper section is openable substantially entirely to uncover the floor;

means to provide a seal between a non-hinged part of the lowermost edge of the upper section and an adjacent non-hinged part of the perimeter edge of the base;

the enclosure including a vestibule having means for providing heat-loss limiting entry or exit of a person from the enclosure;

means for facilitating manual inflation of the inflatable floor and inflatable ribs;

self-inflation means comprising a pressurized inflation-gas source, for self-inflation of the inflatable floor and inflatable ribs;

means for securing the shelter in position on ground;

means for providing combustion heat in the interior of the shelter including a fume vent in the upper section;

attachment means for securing the upper section to supplemental external support means;

a self-powered strobe light; and, a sealable fabric door for each of front and rear openings of the vestibule; and, (b) fire igniter means.

23. The kit of claim 22 which further comprises:

(c) fuel tank puncture means;

(d) hose and nozzle means for removing fuel from a fuel tank;

(e) fuel container;

(f) heat retentive clothing for hands and feet;

(g) interiorly suspendible container for heated rocks; and, (h) a small animal trap.

24. An erectable portable emergency shelter for use in cold conditions, which comprises:

a substantially air impermeable, fabric enclosure having an inflatable floor as a base and inflatable ribs for supporting an upper section mountable on the base, the enclosure including a vestibule having means for providing heat-loss limiting entry or exit of a person from the enclosure;

means for facilitating manual inflation of the inflatable floor and inflatable ribs;

self-inflation means comprising a pressurized inflation-gas source, for self-inflation of the inflatable floor and inflatable ribs;

means for securing the shelter in position on ground;

means for providing combustion heat in the interior of the shelter including a fume vent in the upper section;

attachment means for securing the upper section to supplemental external support means;

a self-powered strobe light; and, a sealable fabric door for each of front and rear openings of the vestibule.

25. The shelter of claim 24 wherein the base is substantially circular in perimeter and the upper section is substantially dome-shaped.

* * * * *